US009239584B2

(12) United States Patent
Lerner et al.

(10) Patent No.: US 9,239,584 B2
(45) Date of Patent: Jan. 19, 2016

(54) SELF-ADJUSTABLE CURRENT SOURCE CONTROL CIRCUIT FOR LINEAR REGULATORS

(71) Applicant: Tower Semiconductor Ltd., Migdal Haemek (IL)

(72) Inventors: Valentin Lerner, Petah Tikva (IL); Danny Pollak, Kadima (IL)

(73) Assignee: Tower Semiconductor Ltd., Migdal Haemek (IL)

( * ) Notice: Subject to any disclaimer, the term of this patent is extended or adjusted under 35 U.S.C. 154(b) by 247 days.

(21) Appl. No.: 14/084,538

(22) Filed: Nov. 19, 2013

(65) Prior Publication Data

US 2015/0137780 A1 May 21, 2015

(51) Int. Cl.
*G05F 1/565* (2006.01)
*G05F 1/575* (2006.01)
*G05F 1/56* (2006.01)

(52) U.S. Cl.
CPC . *G05F 1/56* (2013.01); *G05F 1/565* (2013.01)

(58) Field of Classification Search
CPC ..... G05F 1/56; G05F 1/565; G05F 1/575
USPC ..... 323/269, 273, 274, 279
See application file for complete search history.

(56) References Cited

U.S. PATENT DOCUMENTS 6,377,033 B2 4/2002 Hsu
7,286,011 B2 10/2007 Chang et al.
2008/0218137 A1* 9/2008 Okuyama ..... G05F 1/575 323/273
2008/0265853 A1* 10/2008 Chen ..... G05F 1/571 323/280
2010/0289468 A1* 11/2010 Draghi ..... G05F 1/575 323/282
2011/0121800 A1* 5/2011 Drebinger ..... G05F 1/575 323/273
2015/0015332 A1* 1/2015 Kronmueller ..... H03F 1/342 330/254
2015/0137780 A1* 5/2015 Lerner ..... G05F 1/56 323/280
2015/0212530 A1* 7/2015 Forejtek ..... G05F 1/56 323/280

* cited by examiner

*Primary Examiner* — Jeffrey Sterrett
(74) *Attorney, Agent, or Firm* — Bever, Hoffman & Harms, LLP

(57) ABSTRACT

A self-adjustable current source control circuit utilizes a replica output stage, a sink current source that generates a reference current, and a negative feedback circuit to generate a sink current between a linear regulator output terminal and ground only when a load circuit connected to the linear regulator is in a low power consuming state. The replica output stage includes an 1:N scaled replica of the linear regulator's NMOS (or NPN) output stage transistor, and the negative feedback circuit utilizes two PMOS (or PNP) negative feedback transistors having the same N:1 size ratio and connected as a common gate amplifier, whereby one of the two negative feedback transistors turns on to draw the desired sink current from the regulator output terminal only when the load current falls below N times the reference current (i.e., only the load current is drawn through the output stage transistor during high load current conditions).

20 Claims, 4 Drawing Sheets

SELF-ADJUSTABLE CURRENT SOURCE CONTROL CIRCUIT FOR LINEAR REGULATORS

FIELD OF THE INVENTION

This invention relates to linear regulators for integrated circuits, and more particularly to low-dropout (LDO) regulators having an adjustable bias current.

BACKGROUND OF THE INVENTION

DC linear voltage regulators are circuits utilized to supply a regulated output voltage to a load circuit, and typically include an output stage transistor (e.g., a power FET) and a differential (operational) amplifier (error amplifier). The differential amplifier compares a fraction of the regulated output voltage (which is fed back by way of a voltage divider to the non-inverting input terminal of the differential amplifier) with a stable (bandgap) reference voltage that is supplied to the amplifier's inverting input terminal, and generates a gate voltage that is applied to the gate terminal of the power FET, which is connected between an unregulated voltage supply and the load. During operation, the differential amplifier adjusts (increases or decreases) the gate voltage as needed such that the output voltage is maintained at the desired regulated voltage level. For example, if R/C load conditions change such that the output voltage increases relative to the reference voltage (e.g., by way of the load circuit entering a hibernation or sleep mode), the differential amplifier reduces the gate voltage applied to the power FET, thereby adjusting (reducing) the output voltage to the desired regulated voltage level. Conversely, if the output voltage decreases relative to the reference voltage (e.g., due to the load switching from a sleep mode to a normal operating mode), the differential amplifier increases the gate voltage applied to the power FET, thereby adjusting (increasing) the output voltage to the desired regulated voltage level. By constantly adjusting the output voltage in this way, the LDO regulator maintains a constant regulated voltage across the load.

A low-dropout (LDO) regulator is a type of DC linear voltage regulator that can operate with a very small input-output differential voltage, which provides advantages over other linear voltage regulators by supporting lower minimum operating voltages, providing higher efficiency operations, and reducing heat generation. LDO regulators utilize a current source circuit to stabilize and maintain the regulated output voltage under low or zero load current conditions. The current source circuit is typically coupled in parallel with the load between the regulated output voltage and ground, and functions to draw a minimal sink current through the power FET. That is, when the load enters a standby or sleep mode (i.e., is drawing zero or a very small load current), the current source functions to draw a minimum sink current from the FET in order to maintain the desired regulated voltage across the load.

During periods of zero or low load current, the energy consumption and heat generation produced by the current source circuitry of an LDO are considered acceptable because the generated sink current serves the beneficial purpose of maintaining the regulated output voltage at a stable operating bandwidth, and also because the total amount of heat generated by the LDO is relatively small during these periods. However, under normal operating (i.e., high load current) conditions, unless the current source circuitry is disabled, the current through the power FET is higher than load current (i.e., by the amount of the sink current) without providing a functional benefit, which unnecessarily increases power consumption and heat generation. That is, during high load current conditions, the sink current drawn through the current source circuit provides no benefit in exchange for the consumed energy and generated heat because the high load current facilitates stable LDO operating bandwidth. Moreover, because the sink current flows from the FET output to ground, the amount of heat generated is proportional to the regulated LDO output voltage. As such, in circuits requiring high regulated voltages, heat dissipation in the current source is a significant factor in overall LDO heating, and thus may become a critical factor limiting overall performance of the LDO circuit. Accordingly, although the use of current source circuitry is beneficial during periods of zero or very small load currents, the current source circuitry effectively becomes a liability by undesirably consuming energy and generating heat during periods of high load current.

To reduce power consumption and to avoid possible overheating problems, LDO regulators typically include a mechanism for turning off the sink current source during periods when the load consumes more than the minimum sink current (i.e., when the load is in a normal operating state). Prior art approaches used to turn off the sink current source during high load current conditions use control circuitry to monitor (sense) the load current (or LDO output voltage), and to turn off the sink current source when the load current is higher than the minimum sink current (or when the output voltage falls below a minimum voltage level). A problem with these prior art approaches is that the control circuitry remains active (i.e., continuously draws current) in order to monitor the load conditions. That is, the prior art solution control circuitry continues to draw operating current through the output stage/amplifier at all times in order to continuously monitor the load current, so even when the bias current provider/transistor has been turned off because the load current is greater than the minimum sink current, the control circuitry continues to generate heat and to draw a significant amount of power that reduces battery life in portable devices. Moreover, the complicated control circuitry of the prior art approaches requires a significant amount of chip area, which increases production costs.

What is needed is a linear regulator having an self-adjustable sink current bias source that reliably draws a sink current through the output stage during zero or low load current conditions, and that reliably turns-off the sink current to reduce power consumption and heat generation in the output stage during high load current conditions without requiring a complicated and continuously active control circuit.

SUMMARY OF THE INVENTION

The present invention is directed to a self-adjustable current source control circuit for a linear (e.g., a LDO) regulator circuit in which a replica output stage transistor, a reference current source and a negative feedback circuit are arranged to generate a minimum sink current through the regulator's output stage only during zero or low load current conditions, where the negative feedback circuit automatically turns-off the sink current when the load current increases above the minimum sink current, thereby reduce power consumption and heat generation in the output stage during high load current conditions without requiring a complicated and continuously active control circuit.

According to an exemplary embodiment, a circuit system includes a linear regulator circuit that supplies a regulated output voltage to a load circuit connected to its output terminal, where the regulator circuit includes the self-adjustable current source control circuit that draws a minimum sink current from the regulator's output terminal only during zero or low load current conditions. The linear regulator includes a feedback circuit for generating an output stage gate voltage that controls an output stage transistor connected between an unregulated voltage supply and the regulator's output terminal such that the output stage transistor generates the regulated output voltage on the output terminal. The self-adjustable current source control circuit includes a replica output stage that utilizes the output stage gate voltage and a 1:N scale replica transistor of the output stage transistor to generate a replica regulated output voltage at a replica output node, a sink current source for generating a reference current through the replica output node, and negative feedback circuit that includes a pair of negative feedback transistors connected to form a common gate amplifier, where the first negative feedback transistor is connected in a diode-type arrangement between the replica output node and the sink current source, and the second negative feedback transistor is connected between the regulator output terminal and a low voltage source (e.g., ground or 0V). With this arrangement, the second negative feedback transistor is only enabled (turned on) to draw a sink current through the output stage transistor when the load ent falls below a predetermined minimum current level determined by the reference current.

According to an aspect of the present invention, the replica output stage transistor is a 1:N scale replica of the regulator output stage transistor, and the first negative feedback transistor is a 1:N scale replica of the second negative feedback transistor, whereby the second negative feedback transistor is only enabled (turned on) to draw a sink current through the output stage transistor when the load current falls below N times the reference current. Accordingly, by fabricating self-adjustable current source control circuit using a high scale value N, a very low reference current can be used to control the minimum sink current, which minimizes power consumption and heat generation during high load conditions.

According to alternative exemplary embodiments, linear regulators are fabricated using either MOSFET or bipolar transistors.

BRIEF DESCRIPTION OF THE DRAWINGS

These and other features, aspects and advantages of the present invention will become better understood with regard to the following description, appended claims, and accompanying drawings, where:

FIGS. 2A and 25 are partial simplified circuit diagrams showing the system of FIG. 1 during a zero/low load current operating state and a normal operating state, respectively.

DETAILED DESCRIPTION OF THE DRAWINGS

The present invention relates to an improvement in linear regulators, and in particular to improvements in low dropout (LDO) regulators. The following description is presented to enable one of ordinary skill in the art to make and use the invention as provided in the context of a particular application and its requirements. The terms "coupled" and "connected", which are utilized herein, are defined as follows. The term "connected" is used to describe a direct connection between two circuit elements, for example, by way of a metal line formed in accordance with normal integrated circuit fabrication techniques. In contrast, the term "coupled" is used to describe either a direct connection or an indirect connection between two circuit elements. For example, two coupled elements may be directly connected by way of a metal line, or indirectly connected by way of an intervening circuit element (e.g., a capacitor, resistor, inductor, or by way of the source/drain terminals of a transistor). Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
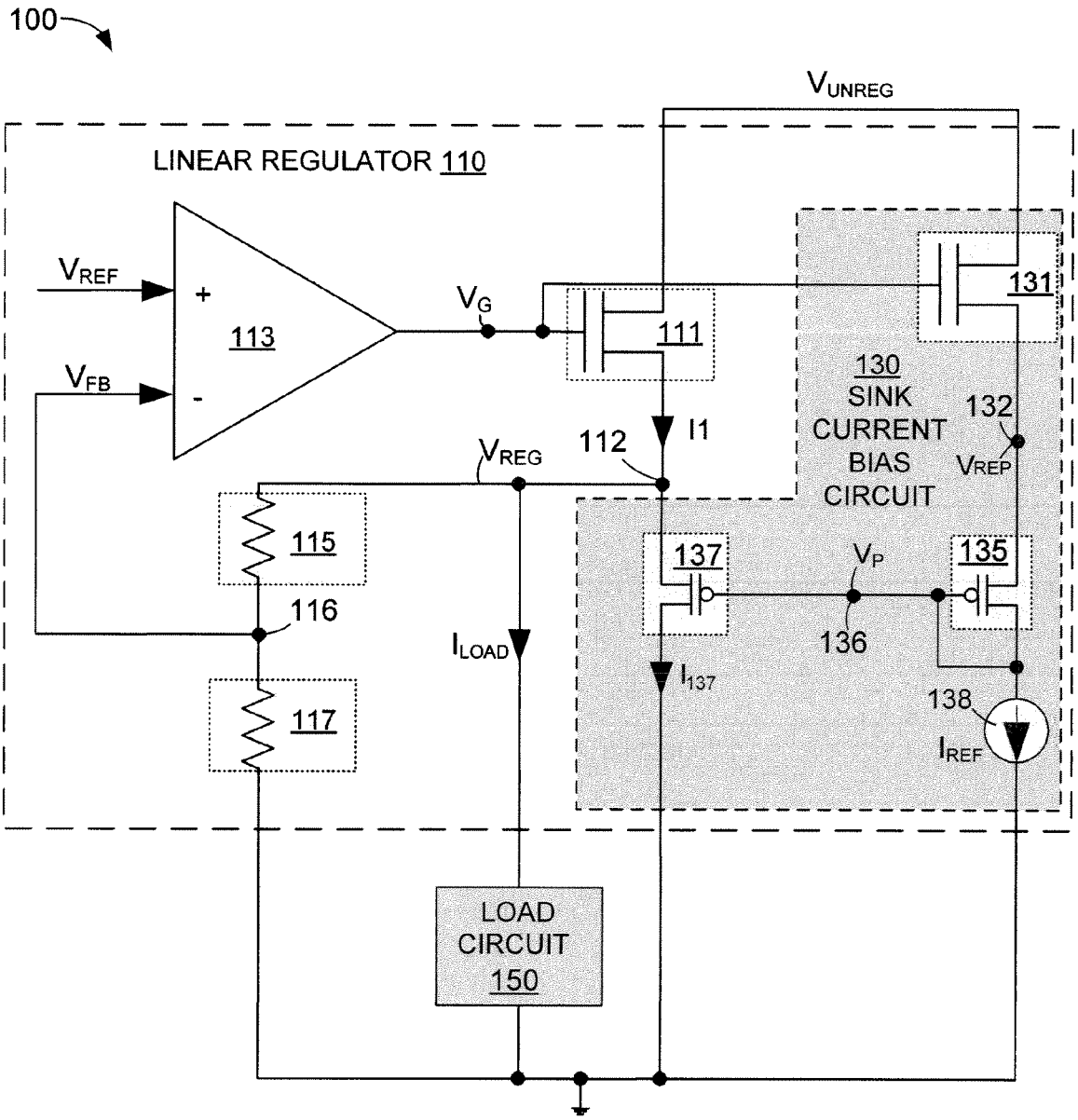
FIG. 1 is a simplified circuit diagram showing a system including a linear regulator according to an exemplary embodiment of the present invention.

FIG. 1 is a circuit diagram showing a system 100 including a low dropout (linear) regulator circuit 110 and a load circuit 150 according to an exemplary CMOS embodiment of the present invention. In one embodiment, system 100 is an integrated circuit entirely fabricated on a semiconductor (e.g., monocrystalline silicon) substrate (chip). In other embodiments, one or more components of system 100 (e.g., resistors 115 and 117) are fabricated separately and attached using known techniques to the chip on which the remaining circuitry is fabricated. Load circuit 150 is configured to perform one or more logic functions, such as those performed by a microcontroller unit (MCU) or a central processing unit (CPU), and is characterized in that the operating state of load circuit 150 periodically shifts between a low power consuming state (e.g., a sleep or hibernation mode) during which a load current $I_{LOAD}$ through load circuit 150 is at a zero (or very low) current level, and a normal operating state in which load current $I_{LOAD}$ through load circuit 150 is at a relatively high current level.

Similar to conventional linear regulators, linear regulator 110 includes circuitry for generating a regulated output voltage $V_{REG}$ on an output terminal 112 to which load circuit 150 is connected (i.e., such that load circuit 150 is connected between regulated output voltage $V_{REG}$ and a low voltage source (e.g., 0V or system ground). In the embodiment shown in FIG. 1, this circuitry includes an output stage (first NMOS) transistor 111 connected between an unregulated voltage supply $V_{UNREG}$ and output terminal 112, and output stage control circuitry that serves to generate an output stage gate voltage $V_G$ applied to the gate terminal output stage transistor 111 such that output stage transistor 111 generates regulated output voltage $V_{REG}$ on output terminal 112. In the present embodiment, this output stage control circuitry is implemented by an operational (differential) amplifier 113 having an inverting (first) input terminal "–" connected to receive a feedback voltage $V_{FB}$, a non-inverting (second) input terminal "+" connected to receive an externally supplied reference voltage $V_{REF}$, and an output terminal connected to the gate terminal of output stage transistor 111. Feedback voltage $V_{FB}$ is generated, for example, using a voltage divider circuit including a first resistor 115 and a second resistor 117 coupled in series between output terminal 112 and ground, where the inverting input terminal of differential amplifier 113 is connected to a feedback node 116 disposed between first and second resistors 115 and 117. The above described portion of linear regulator 110 is constructed and functions according to known techniques.

According to an aspect of the present invention, linear regulator 110 also includes a self-adjustable current source control circuit 130 that activates to generate a minimum sink current through output stage transistor 111 only when load circuit 150 is in the low power state in order to satisfy minimal required load current conditions maintaining regulated output voltage $V_{REG}$, and de-activates during normal operation states in order to prevent unnecessary current consumption heat heat generation. As set forth below self-adjustable sink current source circuit 130 is distinguishable over conventional current source control circuits in that it utilizes a small number (e.g., three) of 1:N scaled transistors, and does not require an externally generated reference signal, whereby the present invention avoids the complicated and large control circuitry utilized in conventional circuits.

Referring to FIG. 1, self-adjustable current source control circuit 130 generally comprises a replica output stage formed by a replica output stage transistor 131 for generating a replica regulated output voltage $V_{REP}$ on a replica output node 132, a (sink) current source 138 coupled between replica output node 132 and ground, and a negative feedback circuit formed by (first) transistor 135 connected between the replica output node 132 and current source 138 and a (second) transistor 137 connected between the regulator output terminal 112 and ground for generating a sink current $I_{137}$ between regulator output terminal 112 and ground only when load circuit 150 is in the low power consuming state (i.e., when load current $I_{LOAD}$ is zero or below a predetermined minimum current level). Current source 138 is configured according to known techniques to generate a reference current $I_{REF}$ that is optimized for the expected load conditions.

According to an aspect of the present invention, replica output stage transistor 131 is a 1:N scale replica of output stage transistor 111 that is connected between unregulated voltage supply $V_{UNREG}$ and replica output node 132, and has a gate terminal connected to the output terminal of differential amplifier 113 (i.e., such that both output stage transistor 111 and replica output stage transistor 131 are controlled by output stage gate voltage $V_G$). The phrase "1:N scale replica" is defined herein to mean that replica output stage transistor 131 is fabricated using the same transistor layout pattern and is produced during the same photolithographic processing steps, but has effective width/length ratio that is 1/N times the effective width/length ratio of output stage transistor 111, where N is a real number/integer greater than 1. In the exemplary embodiment shown in FIG. 1, output stage transistor 111 is an NMOS transistor having a size (cell area) determined by the expected load current D during normal operating conditions, and replica output stage transistor 131 is an NMOS transistor having a size (cell area) that is 1/N times the size of output stage transistor 111.

According to another aspect of the present invention, first negative feedback transistor 135 and second negative feedback transistor 137 are connected to form a common gate amplifier that is controlled by sink current source 138. Specifically, the gate and drain terminals of first negative feedback transistor 135 are connected in a diode-type arrangement to sink current source 138, and its source terminal connected to replica output node 132, whereby a reference current $I_{REF}$ generated by sink current source 138 continuously passes from replica output stage transistor 131 and first negative feedback transistor 135, whereby a negative feedback voltage $V_P$ generated on a negative feedback node 136 is generated in the manner described in additional detail below. Second negative feedback transistor 137 has a gate terminal connected to negative feedback node 136 (i.e., to sink current source 138), a source terminal connected to regulator output terminal 112, and a drain terminal connected to ground. Feedback transistors 135 and 137 are thus connected to form a common gate amplifier, where negative feedback voltage $V_P$ controls the operating states of feedback transistors 135 and 137 in the manner described below such that second negative feedback transistor 137 only turns on when load current $I_{LOAD}$ falls below a predetermined minimum current level determined by reference current $I_{REF}$.

According to yet another aspect of the present invention, second PMOS transistor 137 is a 1:N scale replica of the first PMOS transistor 135 in order to generate sink current $I_{137}$ through output stage transistor 111 only when load current $I_{LOAD}$ is zero or below a predetermined minimum current level determined by the scale factor 1:N. In the embodiment shown in FIG. 1, second negative feedback transistor 137 is a PMOS transistor having a size (cell area) determined by the expected sink current during low power consumption conditions, and first negative feedback transistor 135 is a replica PMOS transistor having a size (cell area) that is 1/N times the size of second negative feedback transistor 137.

Figure 2A:
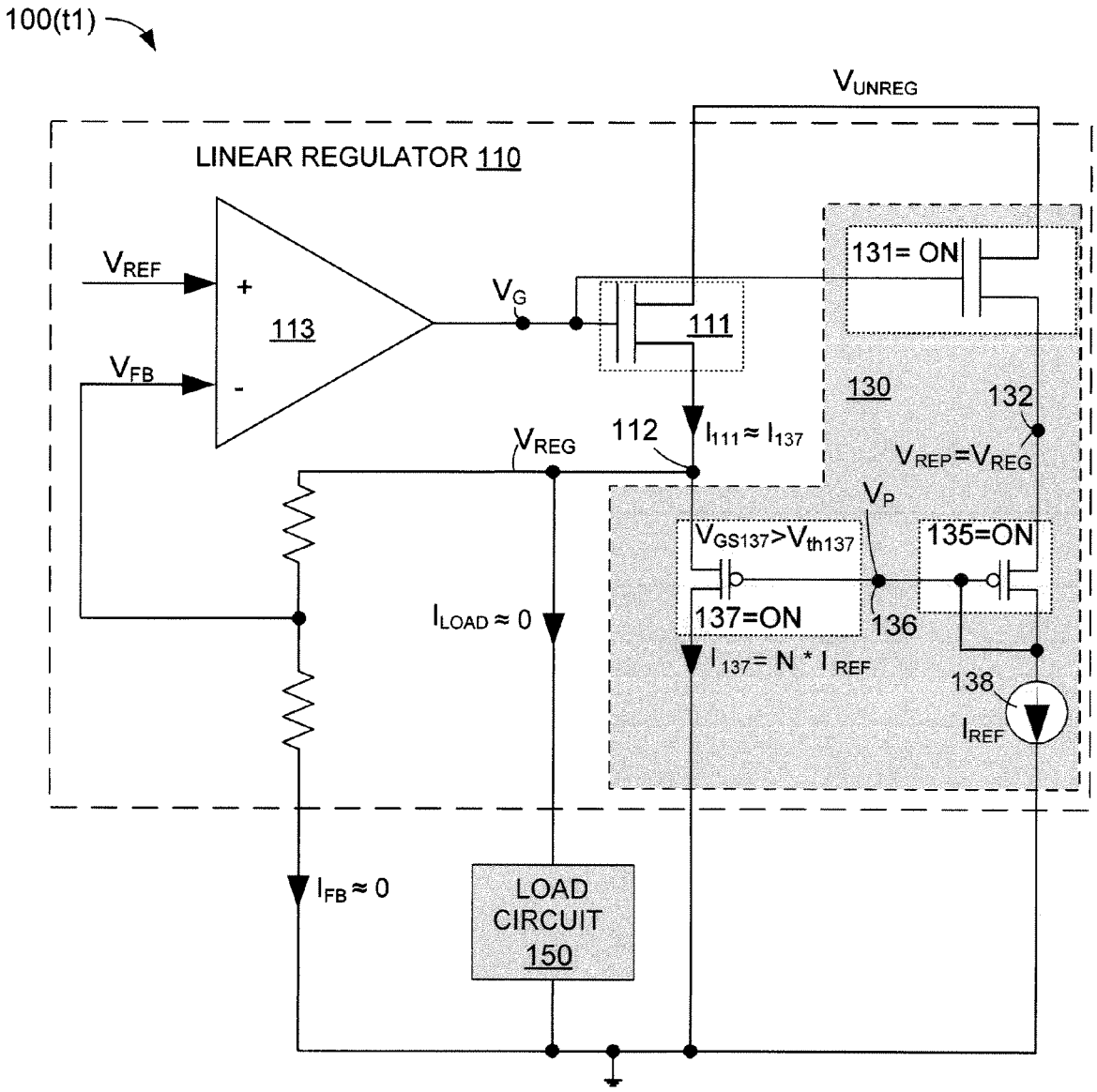
Figure 2B:
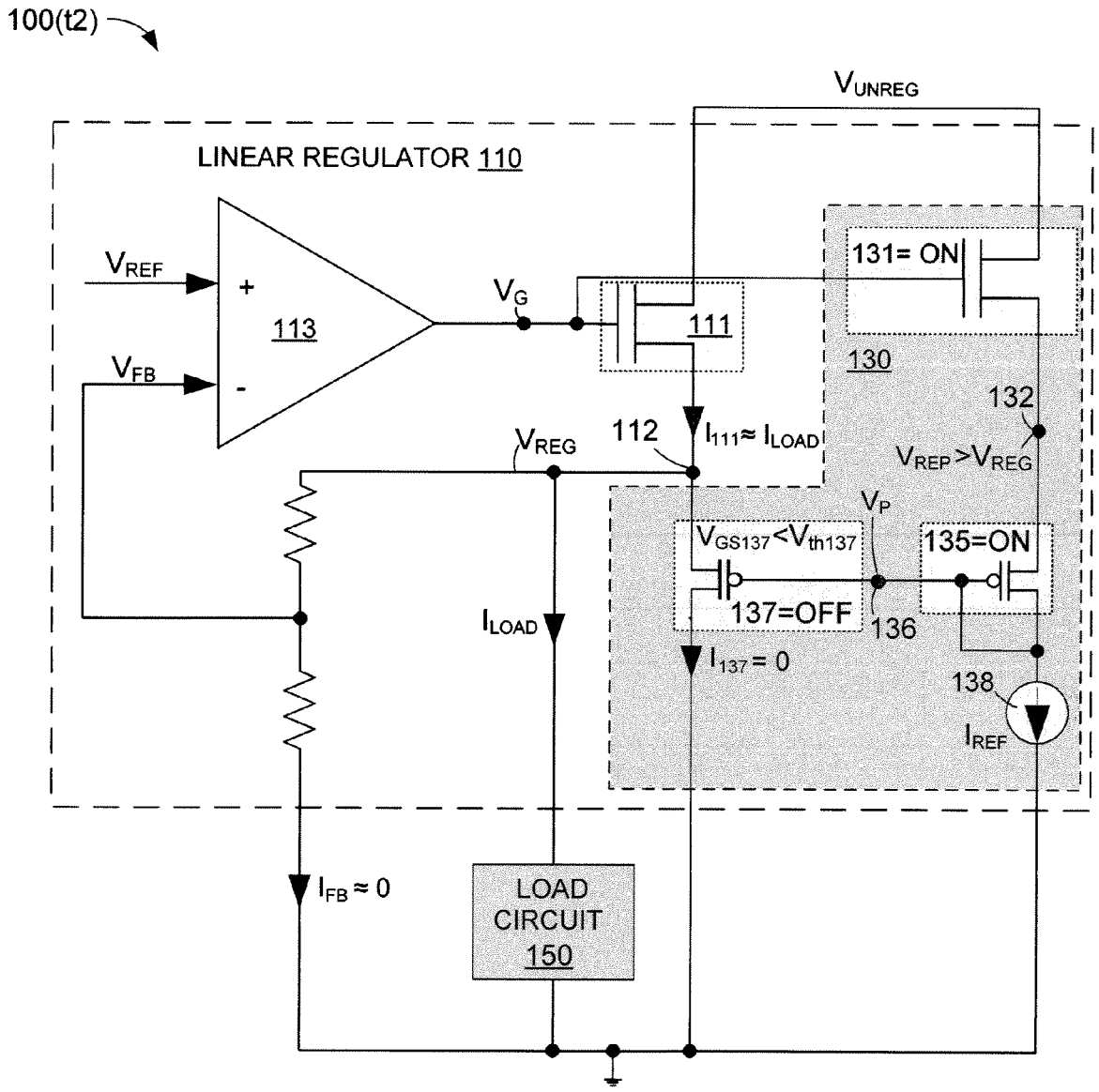

Operation of circuit 100 is described below with reference to FIGS. 2A and 2B, which respectively show circuit 100 at a time t1 during zero/low load current conditions, and at a time t2 during high load current conditions, respectively. As set forth below with reference to Equations 1 to 12, by configuring self-structure current source control circuit 130 according to the arrangement described above with reference to FIG. 1, the zero/low load current condition is determined when current $I_{111}$ through output stage transistor 111 falls below $N*I_{REF}$ (i.e., the reference current generated by current source 138 times the scale factor N). Accordingly, FIG. 2A shows a low power consumption operating state of system 100 when load current $I_{LOAD}$ through output stage transistor 111 is lower than $N*I_{REF}$, and FIG. 2B shows system 100 when load current $I_{LOAD}$ is greater than $N*I_{REF}$.

Referring to system 100 (t1) (i.e., system 100 at time t1, shown in FIG. 2A), when load current $I_{LOAD}$ drops to approximately zero, the output stage current $I_{111}$ through output stage transistor 111 is determined by feedback current $I_{FB}$ through the voltage divider, which for purposes of explanation will be considered as being approximately zero. Under the $I_{111}<N*I_{REF}$ condition, regulated output voltage $V_{REG}$ voltage is established by Equation 1:

$$V_{REG}=V_G-V_{th111}-I_{111}/g_{m111} \quad \text{(Eq. 1)}$$

where $V_{th111}$ is the threshold voltage of output stage transistor 111 and $g_{m111}$ is the transconductance of output stage transistor 111. In a similar manner, replica output voltage $V_{REP}$ (which is generated at replica output node 132 between replica output stage transistor 131 and negative feedback transistor 135) is established by Equation 2:

$$V_{REP}=V_G-V_{th131}-I_{REF}/g_{m131} \quad \text{(Eq. 2)}$$

where $V_{th131}$ is the threshold voltage of replica output stage transistor 131, $g_{m131}$ is the transconductance of replica output stage transistor 131, and $I_{REF}$ is the fixed current drawn by current source 138 through replica transistor 131 and second transistor 135. By rearranging the variables to solve for gate voltage $V_G$, Equation 2 may be rewritten as Equation 2A:

$$V_G=V_{REP}+V_{th131}+I_{REF}/g_{m131} \quad \text{(Eq. 2A)}$$

Because replica transistor 131 is an 1:N scale replica of output stage transistor 111, their threshold voltages are equal (i.e., $V_{th131}=V_{th111}$). Using this relationship and substituting the value of gate voltage $V_G$ from Equation 2A into Equation 1 leads to:

$$V_{REG}=V_{REP}-I_{111}/g_{m111}+I_{REF}/g_{m131} \quad \text{(Eq. 3)}$$

Negative feedback gate voltage $V_P$, which is the voltage generated at the gate terminals of negative feedback transistors 135 and 137, is established by conventional circuit analysis as follows:

$$V_P = V_{REP} - V_{th135} - I_{REF}/g_{m135} \quad \text{(Eq. 4)}$$

where $V_{th135}$ is the threshold voltage of first negative feedback transistor 135, and $g_{m135}$ is the transconductance of first negative feedback transistor 135. In a similar manner, regulated output voltage $V_{REG}$ can be expressed as:

$$V_{REG} = V_P + V_{th137} + I_{137}/g_{m137} \quad \text{(Eq. 5)}$$

where $V_{th137}$ and $g_{m135}$ are the threshold voltage and transconductance of second negative feedback transistor 137, respectively. Because first negative feedback transistor 135 is replica of second negative feedback transistor 137, the threshold voltages of these two transistors are equal (i.e., $V_{th135} = V_{th137}$). Therefore, solving (4) and (5) relative to regulated output voltage $V_{REG}$ leads to:

$$V_{REG} = V_{REP} + I_{137}/g_{m137} - I_{REF}/g_{135} \quad \text{(Eq. 6)}$$

Equalizing equations 3 and 6 leads to:

$$I_{137}/g_{m137} - I_{REF}/g_{m135} = I_{REF}/g_{m131} - I_{111}/g_{m111} \quad \text{(Eq. 7)}$$

As mentioned above, this structure in its operational region forms a negative feedback loop with amplifier 113. Regulated output voltage $V_{REG}$ is always regulated through the feedback network (i.e., resistors 115 and 117 and amplifier 113). Self-adjustable current source control circuit 130 causes output stage current $I_{111}$ to equal $N*I_{131}$ by way of negative feedback transistors 135 and 137, which are connected as common gate amplifier, so regulated output voltage $V_{REG}$ equals replica output voltage $V_{REP}$. Because the current densities through output stage transistor 111 and replica transistor 131 are equal, and their gate voltages are common (i.e., both are equal to gate voltage $V_G$), the transconductances of the two transistors is proportion, i.e.:

$$g_{m131} = g_{m111}/N \quad \text{(Eq. 8)}$$

Also, because replica output stage transistor 131 is scaled 1:N to output stage transistor 111 and both receive same gate voltage $V_G$, the gate-source voltage ($V_{gs}$) of replica output stage transistor 131 is equal to that of output stage transistor 111. Similarly, because the current densities through negative feedback transistors 135 and 137 are equal, and their gate voltages are common (i.e., both are equal to negative feedback gate voltage $V_P$), the transconductances of the negative feedback transistors 135 and 137 is proportion, i.e.:

$$g_{m135} = g_{m137}/N \quad \text{(Eq. 9)}$$

Also, because first negative feedback transistor 135 is scaled 1:N to second negative feedback transistor 137 and both receive same gate voltage $V_P$, the gate-source voltage ($V_{gs}$) of first negative feedback transistor 135 is equal to that of second negative feedback transistor 137, which means the current through second negative feedback transistor 137 is equal to N times the current through first negative feedback transistor 135, which is equal to reference current IREF generated by current source 138, or:

$$I_{137} = N*I_{135} = N*I_{REF} \quad \text{(Eq. 10)}$$

Substituting Equations 8, 9 and 10 into Equation 7 provides:

$$N*I_{REF}/g_{m131} - N*I_{REF}/g_{m131} = N*I_{REF}/g_{m111} - I_{111}/g_{m111} \quad \text{(Eq. 11)}$$

Subtracting and minimizing the terms in Equation 11 provides:

$$I_{111} = I_{137} = N*I_{REF} \quad \text{(Eq. 12)}$$

That is, during zero/low load current conditions, the output stage current $I_{111}$ is maintained at N times reference current $I_{REF}$ by way of the sink current drawn through second negative feedback transistor 137.

As set forth above, differential amplifier 113 applies the same gate voltage $V_G$ to the gate terminals of output stage transistor 111 and replica transistor 131. When the sum of load current $I_{LOAD}$ and feedback current $I_{FB}$ is lower than $N*I_{REF}$, self-structure current source control circuit 130 activates (by way gate voltage $V_G$ applied to the gate terminal of replica transistor 131) to form a negative feedback network that applies the desired sink current to output terminal 112 (i.e., current $I_{137}$ through second negative feedback transistor 137), whereby output stage current $I_{111}$ is approximately equal to sink current $I_{137}$, which in turn is approximately equal to $N*I_{REF}$.

FIG. 2B shows circuit 100 (t2) during normal operation when load current $I_{LOAD}$ is greater than $N*I_{REF}$. Note that differential amplifier generates gate voltage Because reference current $I_{REF}$ is fixed, the negative feedback loop produced by self-adjustable current source control circuit 130 is not able to match the load current, which causes regulated output voltage $V_{REG}$ to drop below replica output voltage $V_{REP}$. Accordingly, second negative feedback transistor 137 enters its cut off operating region (i.e., turns off) because its $V_{GS}$ voltage drops below its threshold voltage (i.e., $V_{GS137} < V_{th137}$), thus causing self-adjustable current source control circuit 130 to reliably turn-off the sink current source to reduce power consumption and heat generation during high load current conditions without requiring a complicated and continuously active control circuit. That is, as indicated in FIG. 2B, output stage current $I_{111}$ is essentially equal to $I_{LOAD}$ at time t2.

Figure 3:
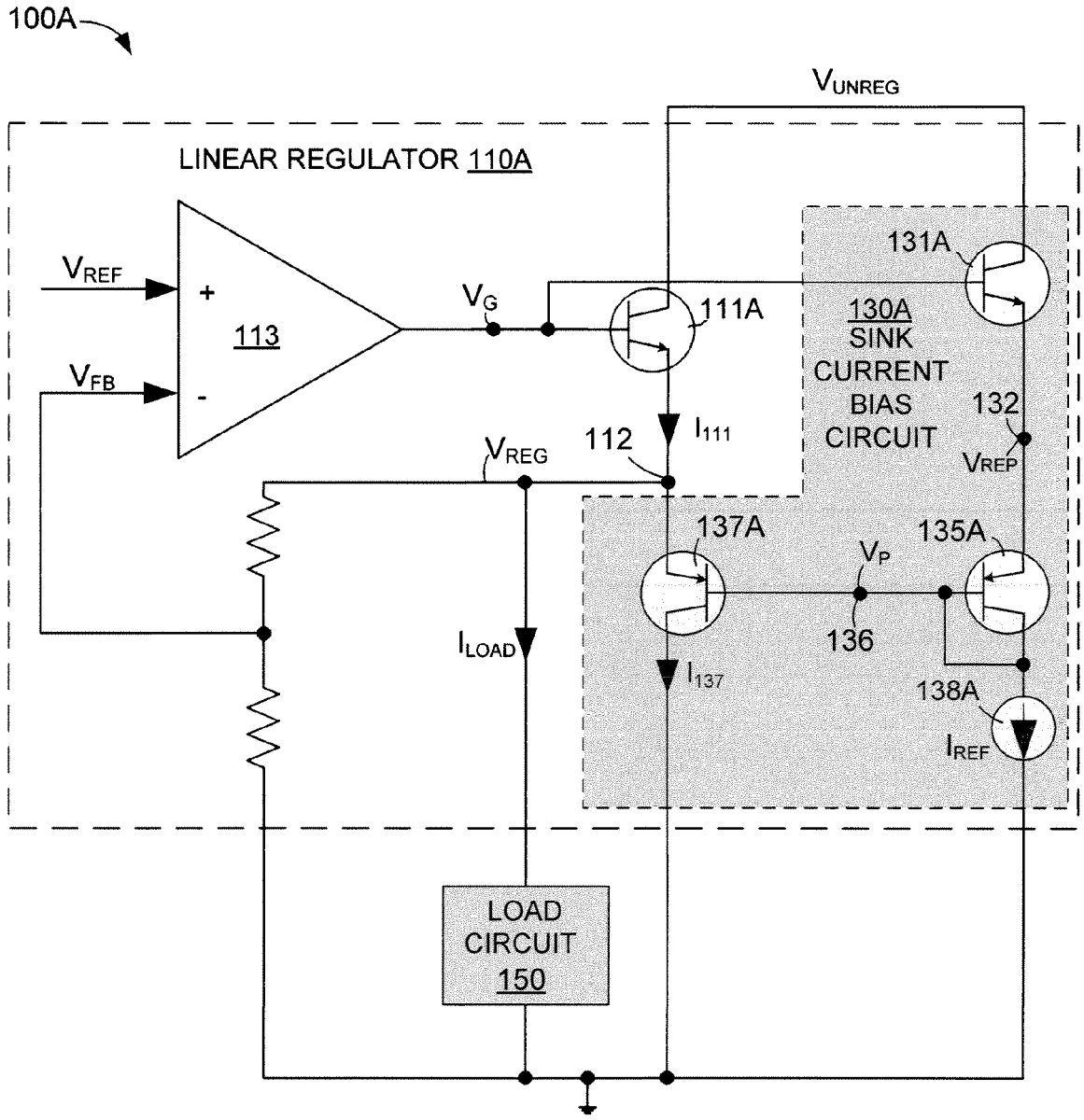
FIG. 3 is a simplified circuit diagram showing a system including a linear regulator according to another embodiment of the present invention.

FIG. 3 is a circuit diagram showing a system 100A including a linear regulator circuit 110A and a load circuit 150 according to an alternative exemplary embodiment of the present invention. Similar to the previous embodiment, linear regulator circuit 110A an output stage transistor 111A connected between an unregulated voltage supply $V_{UNREG}$ and output terminal 112, output stage control circuitry implemented by a differential (operational) amplifier 113 and a voltage divider circuit, and a self-adjustable current source control circuit 130A. Linear regulator circuit 110A differs from the previous embodiment in that output stage transistor 111A is implemented using a (first) NPN transistor having a base terminal connected to receive a output stage gate voltage $V_G$ generated by differential amplifier 113, a collector terminal connected to unregulated voltage supply $V_{UNREG}$, and an emitter terminal connected to output terminal 112. In addition, linear regulator circuit 110A differs from the previous embodiment in that self-adjustable current source control circuit 130A is formed using NPN and PNP transistors (i.e., instead of MOSFET transistors), but is otherwise configured in accordance with the features set forth above, and operates in a manner similar to that set forth above. That is, self-adjustable current source control circuit 130A generally comprises a replica output stage formed by a replica (second NPN) output stage transistor 131A for generating a replica regulated output voltage $V_{REP}$ on a replica output node 132, a (sink) current source 138A coupled between replica output node 132 and ground, and a negative feedback circuit formed by (first PNP) negative feedback transistor 135A connected between the replica output node 132 and current source 138A and a (second PNP) transistor 137A connected between regulator output terminal 112 and ground for generating a sink current between regulator output terminal 112 and ground only when load circuit 150 is in the low power consuming state. Similar to the arrangement described above, replica output stage transistor 131A is a 1:N scale replica of output stage transistor 111A, and negative feedback transistor 135A is a 1:N scale replica of second negative feedback transistor 137A. Replica output stage transistor 131A has a base terminal connected to the output terminal of differential amplifier 113, a collector terminal connected to unregulated voltage supply $V_{UNREG}$ and an emitter terminal connected to replica output node 132. First negative feedback transistor 135A is connected in a diode-type arrangement between replica output node 132 and sink current source 138A, with its base and collector terminals connected to sink current source 138A, and its emitter terminal connected to replica output node 132. Second negative feedback transistor 137A has a base terminal connected to sink current source 138, an emitter terminal connected to regulator output terminal 112, and a collector terminal connected to ground. Feedback transistors 135 and 137 are thus connected to form a common gate amplifier, where a negative feedback voltage $V_P$ generated on a negative feedback node 136 controls the operating states of feedback transistors 135 and 137 in the manner described in additional detail below.

As set forth above, self-adjustable current source control circuits of the present invention achieve the ideal functionality (i.e., reliably applying a sink current to the output stage during zero/low load current conditions, and terminating the sink current during high load current conditions) without requiring an externally generated reference signal, thereby avoiding the complicated and large control circuitry utilized in conventional circuits. Further, because the self-adjustable current source control circuits utilize 1:N scaled transistors to determine the amount of sink current consumed during zero/low load current conditions, the amount of sink current drawn through the output stage is reliably set by the 1:N scale factor, whereby the sink current is limited to the current consumed by the negative feedback amplifier. Moreover, the present invention guarantees by its design that the sink current is only drawn during zero/low load currents and shuts off during high load current conditions, thus minimizing power consumption and heat generation.

Although the present invention has been described with respect to certain specific embodiments, it will be clear to those skilled in the art that the inventive features of the present invention are applicable to other embodiments as well, all of which are intended to fall within the scope of the present invention.

The invention claimed is:

1. A system including a regulator circuit and a load circuit connected to an output terminal of the regulator circuit, wherein the regulator circuit comprises:

an output stage transistor connected between an unregulated voltage supply and the output terminal;

means for generating an output stage gate voltage that is supplied to the gate terminal of the output stage transistor such that said output stage transistor generates a regulated output voltage on the output terminal; and a self-adjustable current source control circuit including:

a replica output stage transistor connected between the unregulated voltage supply and a replica output node;

a sink current source coupled between the replica output stage transistor and a low voltage source;

a first negative feedback transistor connected between the replica output node and the sink current source; and a second negative feedback transistor connected between the output terminal and the low voltage source, wherein the gate terminals of the first and second feedback transistors are connected to the sink current source.

2. The system of claim 1, wherein the output stage transistor comprises a first NMOS transistor having a gate terminal connected to receive the output stage gate voltage, a drain terminal connected to the unregulated voltage supply and source terminal connected to the output terminal, wherein the replica output stage transistor comprises a second NMOS transistor having a gate terminal connected to receive the output stage gate voltage, a drain terminal connected to the unregulated voltage supply and source terminal connected to the replica output node, and wherein the second NMOS transistor is a 1:N scale replica of the first NMOS transistor, where N is a real number/integer greater than 1.

3. The system of claim 2, wherein the first negative feedback transistor comprises a first PMOS transistor having a gate terminal and a drain terminal connected to the sink current source, and a source terminal connected to the replica output node, wherein the second negative feedback transistor comprises a second PMOS transistor having a gate terminal connected to the sink current source, a source terminal connected to the output terminal, and a drain terminal connected to the low voltage source, wherein the first PMOS transistor is a 1:N scale replica of the second PMOS transistor.

4. The system of claim 3, wherein said means for generating the output stage gate voltage comprises a differential amplifier having a first input terminal connected to receive a feedback voltage, a second input terminal connected to receive an externally supplied reference voltage, and an output terminal connected to the gate terminal of the first NMOS transistor.

5. The system of claim 4, wherein said means for generating the output stage gate voltage further comprises a voltage divider circuit including first and second resistors coupled between the output terminal and the low voltage source, wherein the first input terminal of the differential amplifier is connected to a feedback node disposed between the first and second resistors.

6. The system of claim 5, wherein said differential amplifier comprises an operational amplifier having an inverting input terminal connected to receive said feedback voltage and a non-inverting input terminal connected to receive said externally supplied reference voltage.

7. The system of claim 1, wherein the output stage transistor comprises a first NPN transistor having a base terminal connected to receive the output stage gate voltage, a collector terminal connected to the unregulated voltage supply and an emitter terminal connected to the put terminal, wherein the replica output stage transistor comprises a second NPN transistor having a base terminal connected to receive the output stage gate voltage, a collector terminal connected to the unregulated voltage supply and an emitter terminal connected to the replica output node, and wherein the second NPN transistor is a 1:N scale replica of the first NPN transistor, where N is a real number/integer greater than 1.

8. The system of claim 7, wherein the first negative feedback transistor comprises a first PNP transistor having a base terminal and a collector terminal connected to the sink current source, and an emitter terminal connected to the replica output node, wherein the second negative feedback transistor comprises a second PNP transistor having a base terminal connected to the sink current source, an emitter terminal connected to the output terminal, and a collector terminal connected to the low voltage source, wherein the first PNP transistor is a 1:N scale replica of the second PNP transistor.

9. The system of claim 8, wherein said means for generating the output stage gate voltage comprises a differential amplifier having a first input terminal connected to receive a feedback voltage, a second input terminal connected to receive an externally supplied reference voltage, and an output terminal connected to the base terminal of the first NPN transistor.

10. The system of claim 9, wherein said means for generating the output stage gate voltage further comprises a voltage divider circuit including first and second resistors coupled between the output terminal and the low voltage source, wherein the first input terminal of the differential amplifier is connected to a feedback node disposed between the first and second resistors.

11. The system of claim 10, wherein said differential amplifier comprises an operational amplifier having an inverting input terminal connected to receive said feedback voltage and a non-inverting input terminal connected to receive said externally supplied reference voltage.

12. The system of claim 1, wherein the regulator circuit is a low dropout regulator circuit.

13. A linear regulator circuit for supplying a regulated voltage supply to a load circuit connected to an output terminal of the regulator circuit, wherein the regulator circuit comprises:

means for generating a regulated output voltage on the output terminal; and a self-adjustable current source control circuit including:

means for generating a replica regulated output voltage on a replica output node;

a sink current source coupled between the replica output node and a low voltage source;

a first negative feedback transistor connected between the replica output node and the sink current source; and a second negative feedback transistor connected between the output terminal and the low voltage source, wherein the gate terminals of the first and second feedback transistors are connected to the sink current source.

14. The linear regulator circuit of claim 13, wherein said means for generating a regulated output voltage on the output terminal comprises an output stage transistor connected between an unregulated voltage supply and the output terminal, and a differential amplifier circuit for generating an output stage gate voltage applied to a gate terminal of the output stage transistor, and wherein said means for generating a replica regulated output voltage on the replica output node comprises a replica output stage transistor connected between the unregulated voltage supply and the replica output node and having a gate terminal connected to the gate terminal of the output stage transistor.

15. The linear regulator circuit of claim 14, wherein the output stage transistor comprises a first NMOS transistor having a gate terminal connected to receive the output stage gate voltage, a drain terminal connected to the unregulated voltage supply and source terminal connected to the output terminal, wherein the replica output stage transistor comprises a second NMOS transistor having a gate terminal connected to receive the output stage gate voltage, a drain terminal connected to the unregulated voltage supply and source terminal connected to the replica output node, and wherein the second NMOS transistor is a 1:N scale replica of the first NMOS transistor, where N is a real number/integer greater than 1.

16. The linear regulator circuit of claim 15, wherein the first negative feedback transistor comprises a first PMOS transistor having a gate terminal and a drain terminal connected to the sink current source, and a source terminal connected to the replica output node, wherein the second negative feedback transistor comprises a second PMOS transistor having a gate terminal connected to the sink current source, a source terminal connected to the output terminal, and a drain terminal connected to the low voltage source, wherein the first PMOS transistor is a 1:N scale replica of the second PMOS transistor.

17. The linear regulator circuit of claim 16, wherein said means for generating the regulated output voltage further comprises a voltage divider circuit including first and second resistors coupled between the output terminal and the low voltage source, wherein the first input terminal of the differential amplifier is connected to a feedback node disposed between the first and second resistors.

18. The linear regulator circuit of claim 14, wherein the output stage transistor comprises a first NPN transistor having a base terminal connected to receive the output stage gate voltage, a collector terminal connected to the unregulated voltage supply and an emitter terminal connected to the output terminal, wherein the replica output stage transistor comprises a second NPN transistor having a base terminal connected to receive the output stage gate voltage, a collector terminal connected to the unregulated voltage supply and an emitter terminal connected to the replica output node, and wherein the second NPN transistor is a 1:N scale replica of the first NPN transistor, where N is a real number/integer greater than 1.

19. The system of claim 18, wherein the first negative feedback transistor comprises a first PNP transistor having a base terminal and a collector terminal connected to the sink current source, and an emitter terminal connected to the replica output node, wherein the second negative feedback transistor comprises a second PNP transistor having a base terminal connected to the sink current source, an emitter terminal connected to the output terminal, and a collector terminal connected to the low voltage source, wherein the first PNP transistor is a 1:N scale replica of the second PNP transistor.

20. A system comprising:

a load circuit connected between a regulator output terminal and a low voltage source, wherein the load circuit is configured to periodically switch between a low power consuming state during which a load current through said load circuit is at a first current level, and a normal operating state in which said load current through said load circuit is at a second current level, the second current level being higher than the first current level; and a linear regulator circuit comprising:

means for generating said regulated output voltage on the regulator output terminal; and a self-adjustable current source control circuit including:

a replica output stage for generating a replica regulated output voltage on a replica output node, said replica regulated output voltage being substantially equal to said regulated output voltage;

a sink current source coupled between the replica output node and the low voltage source; and a negative feedback circuit connected to the replica output node and to the regulator output terminal for generating a sink current between the regulator output terminal and ground only when load circuit is in the low power consuming state.

* * * * *